US009845736B2

(12) United States Patent
Nieddu et al.

(10) Patent No.: US 9,845,736 B2
(45) Date of Patent: Dec. 19, 2017

(54) METHOD OF DETERMINING THE TIMING AND QUANTITY OF FUEL INJECTION TO OPERATE AN INTERNAL COMBUSTION ENGINE

(71) Applicant: GM GLOBAL TECHNOLOGY OPERATIONS LLC, Detroit, MI (US)

(72) Inventors: Stefano Nieddu, Turin (IT); Andrea Mollar, La Loggia (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 36 days.

(21) Appl. No.: 15/004,408

(22) Filed: Jan. 22, 2016

(65) Prior Publication Data

US 2016/0215708 A1 Jul. 28, 2016

(30) Foreign Application Priority Data

Jan. 22, 2015 (GB) ..... 1501066.3

(51) Int. Cl.
*F02D 1/02* (2006.01)
*F02D 41/38* (2006.01)
(Continued)

(52) U.S. Cl.
CPC ..... *F02D 1/02* (2013.01); *F02D 41/2467* (2013.01); *F02D 41/3827* (2013.01);
(Continued)

(58) Field of Classification Search
CPC ..... F02D 1/02; F02D 33/00; F02D 33/006; F02D 41/2467; F02D 41/30;
(Continued)

(56) References Cited

U.S. PATENT DOCUMENTS 5,771,861 A * 6/1998 Musser ..... F02D 41/1401 123/357
6,567,758 B1 * 5/2003 Wuori ..... G06K 9/00523 702/56

(Continued)

FOREIGN PATENT DOCUMENTS

JP 2000257495 A 9/2000

OTHER PUBLICATIONS

Great Britain Patent Office, Great Britain Search Report for Great Britain Application No. 1501066.3, dated Jul. 1, 2015.

*Primary Examiner* — John Kwon
*Assistant Examiner* — Johnny H Hoang
(74) *Attorney, Agent, or Firm* — Lorenz & Kopf, LLP

(57) ABSTRACT

A method of determining the timing and quantity of fuel injection to operate an internal combustion engine is disclosed. While operating the fuel injector to perform a fuel injection; a signal of a fuel pressure within the fuel rail during the fuel injection is sampled. The signal is used to determine first and second integral transforms yielding as output a value of first and second functions having as variables the fuel rail pressure drop caused by the fuel injection and the timing parameter indicative of the instant when the fuel injection started. Values of the first and second functions are used to calculate a value of the fuel rail pressure drop caused by the fuel injection and a value of the timing parameter. A value of a fuel quantity injected by the fuel injection is calculated as a function of the value of the fuel rail pressure drop.

15 Claims, 3 Drawing Sheets

(51) Int. Cl.

| | |
|---|---|
| ***F02D 41/24*** | (2006.01) |
| *F02M 26/05* | (2016.01) |
| *F02M 26/25* | (2016.01) |
| *F02M 26/47* | (2016.01) |
| *F02D 41/28* | (2006.01) |

(52) U.S. Cl.
CPC ..... *F02D 2041/286* (2013.01); *F02D 2200/0602* (2013.01); *F02D 2200/0616* (2013.01); *F02D 2200/0618* (2013.01); *F02M 26/05* (2016.02); *F02M 26/25* (2016.02); *F02M 26/47* (2016.02)

(58) Field of Classification Search
CPC ..... F02D 41/401; F02D 41/3827; F02D 2041/286; F02D 2200/0616; F02D 2200/0618; F02D 2200/0602; F02M 26/05; F02M 26/25; F02M 26/47; Y02T 10/44
USPC ..... 123/295, 299, 445, 447, 456, 457, 460, 123/512; 701/103–105
See application file for complete search history.

(56) References Cited

U.S. PATENT DOCUMENTS

| | | | | |
|---|---|---|---|---|
| 7,523,743 | B1 * | 4/2009 | Geveci | F02D 41/3863 123/456 |
| 2004/0133350 | A1 * | 7/2004 | Veneruso | G01V 1/36 702/6 |
| 2008/0026095 | A1 * | 1/2008 | Wessely | B29C 45/5008 425/556 |
| 2008/0107764 | A1 * | 5/2008 | MacDonald | B29C 45/16 425/190 |
| 2009/0164086 | A1 * | 6/2009 | Geveci | F02D 41/2438 701/102 |
| 2009/0164094 | A1 | 6/2009 | Geveci et al. | |
| 2009/0164095 | A1 * | 6/2009 | Geveci | F02D 41/0087 701/103 |
| 2010/0030450 | A1 * | 2/2010 | Doelker | F02D 41/3809 701/103 |
| 2013/0311063 | A1 * | 11/2013 | Ito | F02D 41/1497 701/103 |

* cited by examiner

METHOD OF DETERMINING THE TIMING AND QUANTITY OF FUEL INJECTION TO OPERATE AN INTERNAL COMBUSTION ENGINE

CROSS-REFERENCE TO RELATED APPLICATION

This application claims priority to Great Britain Patent Application No. 1501066.3, filed Jan. 22, 2015, which is incorporated herein by reference in its entirety.

TECHNICAL FIELD

The present disclosure pertains to a method of operating an internal combustion engine of a motor vehicle, such as a Diesel engine or a Gasoline engine, and more particularly a method of determining the fuel quantity and timing of fuel injection by an engine fuel injector into a combustion chamber.

BACKGROUND

It is known that an internal combustion engine of a motor vehicle generally includes a fuel injection system having a high pressure fuel pump, which delivers fuel at high pressure to a fuel rail, and a plurality of fuel injectors in fluid communication with the fuel rail. Each injector is provided for injecting metered quantities of fuel inside a corresponding combustion chamber of the engine. Conventionally, each fuel injector performs a plurality of injection pulses per engine cycle, according to a multi-injection pattern. This multi-injection pattern usually includes a main injection, which is executed to generate torque at the crankshaft, and several smaller injections, which may be executed before the main injection (e.g. pilot-injections and pre-injections) and/or after the main injection (e.g. after-injections and post-injections). Each of these small injection pulses is made to inject into the combustion chamber a small quantity of fuel, typically lower than 2.5 $mm^3$ (for example 1 $mm^3$), with the aim of reducing polluting emissions and/or combustion noise of the internal combustion engine.

The fuel injectors are essentially embodied as electromechanical valves having a needle, which is normally biased in a closed position by a spring, and an electro-magnetic actuator (e.g. solenoid), which moves the needle towards an open position in response of an energizing electrical current. The energizing electrical current is provided by an electronic control unit, which is generally configured to determine the fuel quantity to be injected by each single injection pulse, to calculate the duration of the energizing electrical current (i.e. the energizing time) needed for injecting the desired fuel quantity, and finally to energize the fuel injector accordingly.

However, it may happen that the fuel quantity actually injected during an injection pulse is different from the desired one. This undesirable condition may be caused by several factors, including drift of the injection characteristics and production spread of the fuel injectors. In particular, the correlation between the electrical command and the injector needle displacement can be affected by variables that are difficult to control during the injectors manufacturing, such as magnetic permeability drift of the actuator, tolerance of the needle spring coefficient, aging effect, and temperature dependency. Therefore, it is very likely that two fuel injectors (even of the same production slot) behave differently in response of the same electrical command.

As a result of these factors, for a given energizing time and a given fuel rail pressure, the fuel quantity actually injected into the combustion chambers of an internal combustion engine may be different injector-by-injector and/or vary with the aging of the injection system. This problem is particularly critical for the small injection pulses, whose accuracy and repetitiveness is important to achieve the expected improvements in terms of polluting emission and combustion noise.

To solve this drawback, while the internal combustion engine is running under cut-off conditions, the electronic control unit is conventionally configured to perform from time to time a procedure aimed to measure the actual fuel quantity which is injected by each fuel injector. According to the known solutions, the actually injected fuel quantity may be estimated on the basis of input signals deriving from different kinds of sensors such as knock sensors or on the basis of the crankshaft wheel signal.

A drawback of these prior solutions lies in the fact that such fuel quantity estimation is indirect and that the signals involved, for example the crankshaft wheel signal or other signals, are easily affected by noise and all sorts of disturbances coming from external environment such as rough roads, electric loads or other external or internal conditions, so that the resulting estimation may be not always reliable. Another drawback is that some of these known solutions cannot be performed during the execution of the so-called stop-start running strategies.

The stop-start running strategies are strategies that provide for disengaging the clutch and shutting off the engine when the motor vehicle is coasting, thereby saving fuel and reducing pollutant emissions. Under these circumstances, since the clutch is disengaged, some of the sensors involved in the conventional estimation of the fuel injected quantity cannot be used.

Still another drawback of the known solutions is that they are not able to measure the Start Of Injection (SOI). The SOI is a parameter that represents the instant when the injection pulse starts and is usually expressed in terms of an angular position of the engine crankshaft.

The SOI ideally coincides with the instant when the electronic control unit applies the energizing current to the fuel injector. However, due to fuel injector configurations (particularly solenoid injectors), there is always a certain delay between the application of the energizing current and the actual opening of the fuel injector. This delay is not the same for all the fuel injectors but is affected by the same factors that also affect the fuel injected quantity, such as for example the magnetic permeability drift of the actuator, the tolerance of the needle spring coefficient, aging effect, and temperature dependency. As a consequence, it may happen that two fuel injectors of the same kind (e.g. of the same production slot) open at different instants, even if the energizing current is applied at the very same time.

SUMMARY

In accordance with the present disclosure, strategies for determining the actual quantity of fuel injected by a fuel injection are provided, which are more reliable and less affected by external disturbances with respect to the known strategies. Furthermore, the strategies determine the instant when the fuel injection actually occurs. The strategies disclosed herein meet these goals by in a rational and relatively inexpensive solution.

An embodiment of the present disclosure provides a method of operating an internal combustion engine, wherein the internal combustion engine includes a fuel rail in fluid communication with a fuel pump and with a fuel injector. A fuel injector is operated to perform a fuel injection. A pressure signal representative of a fuel pressure within the fuel rail during the fuel injection is sampled and used as an input for a first integral transform yielding as output a value of a first function having as variables a fuel rail pressure drop caused by the fuel injection and a timing parameter indicative of an instant when the fuel injection started. The pressure signal is also used as input of a second integral transform yielding as output a value of a second function having as variables the fuel rail pressure drop caused by the fuel injection and the timing parameter indicative of the instant when the fuel injection started. The value of the first function and the value of the second function are used to calculate a value of the fuel rail pressure drop caused by the fuel injection and a value of the timing parameter. A value of a fuel quantity injected by the fuel injection is calculated as a function of the calculated value of the fuel rail pressure drop.

This solution provides a reliable and effective strategy for determining both the actual injected fuel quantity and the actual timing of the fuel injection, with low computational effort and without requiring additional sensors, thereby representing a cost effective solution. The solution may be performed during strong transient and even during the execution of stop-start running strategies, because the pressure within the fuel rail is not affected by the clutch.

According to an aspect of the present disclosure, the fuel rail pressure signal may be sampled in a crankshaft angular domain (i.e. referred to the angular position of the engine crankshaft). The advantage of this aspect is that the determination of the fuel injected quantity becomes independent from the engine speed.

According to another aspect of the present disclosure, the value of the first function may be calculated with the following integral transform:

$$L_\alpha=\int_0^{2\pi}P(\theta)\cdot\cos(\theta)d(\theta)\cong T_\alpha(\Delta P_{inj},\gamma_{inj})=\Delta P_{inj}\cdot\sin\gamma_{inj}$$

Wherein:

$L_\alpha$ is the value of the first function $T_\alpha$;

P is the fuel rail pressure;

Θ is an angular position of the crankshaft;

0 is a predetermined starting value of an integration interval [0, 2π] in the crankshaft angular domain;

2π is a predetermined final value of the integration interval [0, 2π] in the crankshaft angular domain;

$\Delta P_{inj}$ is the fuel rail pressure drop caused by the fuel injection; and $\gamma_{inj}$ is an angular distance of the fuel injection from the staring value 0 of the integration interval.

As can be understood from the equations, this integral transform is effectively able to yield a value $L_\alpha$ of first function $T_\alpha$ that, with good approximation, depends only on the fuel rail pressure drop $\Delta P_{inj}$ and on the instant when the fuel injection occurs, namely the angular distance $\gamma_{inj}$.

According to another aspect of the present disclosure, the value of the second function may be calculated with the following integral transform:

$$L_\beta=\int_0^{2\pi}P(\theta)\cdot\sin(\theta)d(\theta)\cong T_\beta(\Delta P_{inj},\gamma_{inj})=\Delta P_{inj}\cdot(1-\cos\gamma_{inj})$$

Wherein:

$L_\beta$ is the value of the second function $T_\beta$;

P is the fuel rail pressure;

Θ is the angular position of the crankshaft;

0 is a predetermined starting value of an integration interval [0, 2π] in the crankshaft angular domain;

2π is a predetermined final value of the integration interval [0, 2π] in the crankshaft angular domain;

$\Delta P_{inj}$ is the fuel rail pressure drop caused by the fuel injection; and $\gamma_{inj}$ is an angular distance of the fuel injection from the starting value of the integration interval.

As can be understood from the equations, this integral transform is effectively able to yield a value $L_\beta$ of a second function $T_\beta$ that, with good approximation, depends only on the fuel rail pressure drop and on the instant when the fuel injection occurs, which is still represented by the angular distance $\gamma_{inj}$.

An aspect of the present disclosure provides that the starting value of the integration interval may be an angular position of the crankshaft for which a piston of the fuel pump has already completed the compression stroke. This solution guarantees that, during the integration interval, the fuel rail pressure is not affected by the pump.

According to another aspect of the present disclosure, the value of the fuel quantity injected by the fuel injection may be calculated taking into account a value of a hydraulic capacitance of the fuel rail. This aspect of the present disclosure provides a reliable solution for calculating the fuel injected quantity starting from the pressure drop within the fuel rail.

An aspect of the present disclosure particularly provides that the value of the hydraulic capacitance may be varied on the basis of an average value of the pressure within the fuel rail. This aspect of the present disclosure increases the reliability of the strategy, since the hydraulic capacitance of the fuel rail generally depends on the pressure level.

According to another aspect of the present disclosure, the value of the hydraulic capacitance may be determined with a learning procedure, which is performed while the engine operates under a fuel cut-off condition (even during the execution of a stop-start running strategy). The fuel pump is operated to deliver a predetermined volume of fuel into the fuel rail per compression stroke. A value of a fuel rail pressure increment due to the delivery of said volume of fuel is measured. The value of the hydraulic capacitance are calculated as a function of the volume of fuel delivered into the fuel rail and the measured value of the fuel rail pressure increment. This solution provides a reliable and effective strategy for learning the hydraulic capacitance of the fuel rail.

An aspect of the present disclosure provides that the teaming procedure may further include calculating an average value of the fuel rail pressure during the delivery of said volume of fuel. The calculated value of the hydraulic capacitance is stored in memory, thereby correlating it to the calculated average value of the fuel rail pressure. This solution is used to create an array or map that correlates each value of the fuel rail pressure with a corresponding value of the hydraulic capacitance, which in turn may be effectively used to calculate the fuel injected quantity.

According to an aspect of the present disclosure, the fuel injection performed by the fuel injector may include a single injection pulse. This aspect of the present disclosure, which may be implemented while the internal combustion engine is running under cut-off conditions, can be reliably used to determine the fuel quantity that is actually injected by a single injection pulse.

According to another aspect of the present disclosure, the fuel injection performed by the fuel injector may include a plurality of injection pulses, for example according to a mufti-injection pattern. This aspect of the present disclosure, which may be implemented either under cut-off conditions or normal operating conditions, can be reliably used to determine the overall fuel quantity that is actually injected by the fuel injector per engine cycle.

The method may further include calculating a difference between the calculated value of the fuel injected quantity and a predetermined target value thereof. The calculated difference is used to correct an energizing time of the fuel injector. This aspect of the present disclosure realizes a closed-loop control strategy for compensating possible errors of the fuel injected quantity.

Another aspect of the present disclosure provides that the method may include calculating a difference between the calculated value of the timing parameter and a predetermined target value thereof. The calculated difference is used to correct a start of injection of the fuel injector. This aspect of the present disclosure realizes a closed-loop control strategy for compensating possible errors of the injection timing.

In accordance with the present disclosure, the method may be embodied in a non transitory computer readable medium including a program-code for carrying out all the steps of the method described above, and in the form of a computer program product including the computer program and a electronic control unit. The method can be also embodied as an electromagnetic signal carrying a sequence of data bits which represent a computer program to carry out all steps of the method.

Another embodiment of the present disclosure provides an internal combustion engine including a fuel rail in fluid communication with a fuel pump and with a fuel injector, and an electronic control unit configured to operate the fuel injector to perform a fuel injection, sample a signal representative of a fuel pressure within the fuel rail during the fuel injection, use the pressure signal as input of a first integral transform yielding as output a value of a first function having as variables a fuel rail pressure drop caused by the fuel injection and a timing parameter indicative of an instant when the fuel injection started, use the pressure signal as input of a second integral transform yielding as output a value of a second function having as variables the fuel rail pressure drop caused by the fuel injection and the tinting parameter indicative of the instant when the fuel injection started, use the value of the first function and the value of the second function to calculate a value of the fuel rail pressure drop caused by the fuel injection and a value of the timing parameter, and calculate a value of a fuel quantity injected by the fuel injection as a function of the value of the fuel rail pressure drop.

This embodiment achieves basically the same effects mentioned before, in particular that of providing a reliable and effective strategy for determining both the actual injected fuel quantity and the actual timing of the fuel injection, with low computational effort and without requiring additional sensors, thereby representing a cost effective solution.

According to an aspect of the present disclosure, the electronic control unit may be configured to sample the fuel rail pressure signal in a crankshaft angular domain (i.e. referred to the angular position of the engine crankshaft). The advantage of this aspect is that the determination of the fuel injected quantity becomes independent from the engine speed.

According to another aspect of the present disclosure, the electronic control unit may be configured to calculate the value of the first function with the following integral transform:

$$L_\alpha=\int_0^{2\pi}P(\theta)\cdot\cos(\theta)d(\theta)\cong T_\alpha(\Delta P_{inj},\gamma_{inj})=\Delta P_{inj}\cdot\sin\gamma_{inj}$$

wherein:

$L_\alpha$ is the value of the first function $T_\alpha$;

P is the fuel rail pressure;

$\Theta$ is the angular position of the crankshaft;

0 is a predetermined starting value of an integration interval [0, 2π] in the crankshaft angular domain;

2π is a predetermined final value of the integration interval [0, 2π] in the crankshaft angular domain;

$\Delta P_{inj}$ is the fuel rail pressure drop caused by the fuel injection; and $\gamma_{inj}$ is an angular distance of the fuel injection from the staring value 0 of the integration interval.

As can be understood from the equations, this integral transform is effectively able to yield a value $L_\alpha$ of first function $T_\alpha$ that, with good approximation, depends only on the fuel rail pressure drop $\Delta P_{inj}$ and on the instant when the fuel injection occurs, namely the angular distance $\gamma_{inj}$.

According to another aspect of the present disclosure, the electronic control unit may be configured to calculate the value of the second function with the following integral transform:

$$L_\beta=\int_0^{2\pi}P(\theta)\cdot\sin(\theta)d(\theta)\cong T_\beta(\Delta P_{inj},\gamma_{inj})=\Delta P_{inj}\cdot(1-\cos\gamma_{inj})$$

wherein:

$L_\beta$ is the value of the second function $T_\beta$;

P is the fuel rail pressure;

$\Theta$ is the angular position of the crankshaft;

0 is a predetermined starting value of an integration interval [0, 2π] in the crankshaft angular domain;

2π is a predetermined final value of the integration interval [0, 2π] in the crankshaft angular domain;

$\Delta P_{inj}$ is the fuel rail pressure drop caused by the fuel injection; and $\gamma_{inj}$ is the angular distance of the fuel injection from the starting value of the integration interval.

As can be understood from the equations, this integral transform is effectively able to yield a value $L_\beta$ of a second function $L_\beta$ that, with good approximation, depends only on the fuel rail pressure drop and on the instant when the fuel injection occurs, which is still represented by the angular distance $\gamma_{inj}$.

An aspect of the present disclosure provides that the starting value of the integration interval may be an angular position of the crankshaft for which a piston of the fuel pump has already completed the compression stroke. This solution guarantees that, during the integration interval, the fuel rail pressure is not affected by the pump.

According to another aspect of the present disclosure, the electronic control unit may be configured to calculate the value of the fuel quantity injected by the fuel injection taking into account a value of an hydraulic capacitance of the fuel rail. This aspect of the present disclosure provides a reliable solution for calculating the fuel injected quantity starting from the pressure drop within the fuel rail.

An aspect of the present disclosure particularly provides that the electronic control unit may be configured to vary the value of the hydraulic capacitance on the basis of an average value of the pressure within the fuel rail. This aspect of the present disclosure increases the reliability of the strategy, since the hydraulic capacitance of the fuel rail generally depends on the pressure level.

According to another aspect of the present disclosure, the electronic control unit may be configured to determine the value of the hydraulic capacitance with a teaming procedure, which is performed while the engine operates under a fuel cut-off condition (even during the execution of a stop-start running strategy) and which includes operating the fuel pump to deliver a predetermined volume of fuel into the fuel rail per compression stroke, measuring a value of a fuel rail pressure increment due to the delivery of said volume of fuel, and calculating the value of the hydraulic capacitance as a function of the volume of fuel delivered into the fuel rail and the measured value of the fuel rail pressure increment. This solution provides a reliable and effective strategy for learning the hydraulic capacitance of the fuel rail.

An aspect of the present disclosure provides that the leaning procedure may include calculating an average value of the fuel rail pressure during the delivery of said volume of fuel, storing the calculated value of the hydraulic capacitance, thereby correlating it to the calculated average value of the fuel rail pressure. This solution allows to create an array or map that correlates each value of the fuel rail pressure with a corresponding value of the hydraulic capacitance, which in turn may be effectively used to calculate the fuel injected quantity.

According to an aspect of the present disclosure, the fuel injection performed by the fuel injector may include a single injection pulse. This aspect of the present disclosure, which may be implemented while the internal combustion engine is running under cut-off conditions, can be reliably used to determine the fuel quantity that is actually injected by a single injection pulse.

According to another aspect of the present disclosure, the fuel injection performed by the fuel injector may include a plurality of injection pulses, for example according to a multi-injection pattern. This aspect of the present disclosure, which may be implemented either under cut-off conditions or normal operating conditions, can be reliably used to determine the overall fuel quantity that is actually injected by the fuel injector per engine cycle.

The electronic control unit may be further configured to calculate a difference between the calculated value of the fuel injected quantity and a predetermined target value thereof, and use the calculated difference to correct an energizing time of the fuel injector. This aspect of the present disclosure realizes a closed-loop control strategy for compensating possible errors of the fuel injected quantity.

Another aspect of the present disclosure provides that the electronic control unit may be further configured calculate a difference between the calculated value of the timing parameter and a predetermined target value thereof, and use the calculated difference to correct a start of injection of the fuel injector. This aspect of the present disclosure realizes a closed-loop control strategy for compensating possible errors of the injection timing.

Another embodiment of the present disclosure provides an apparatus for operating an internal combustion engine, wherein the internal combustion engine includes a fuel rail in fluid communication with a fuel pump and with a fuel injector. The apparatus includes means for operating the fuel injector to perform a fuel injection, means for sampling a signal representative of a fuel pressure within the fuel rail during the fuel injection, means using the pressure signal as input of a first integral transform yielding as output a value of a first function having as variables a fuel rail pressure drop caused by the fuel injection and a timing parameter indicative of an instant when the fuel injection started, means for using the pressure signal as input of a second integral transform yielding as output a value of a second function having as variables the fuel rail pressure drop caused by the fuel injection and the timing parameter indicative of the instant when the fuel injection started, means for using the value of the first function and the value of the second function to calculate a value of the fuel rail pressure drop caused by the fuel injection and a value of the timing parameter, and means for calculating a value of a fuel quantity injected by the fuel injection as a function of the value of the fuel rail pressure drop.

This embodiment achieves basically the same effects mentioned before, in particular that of providing a reliable and effective strategy for determining both the actual injected fuel quantity and the actual timing of the fuel injection, with low computational effort and without requiring additional sensors, thereby representing a cost effective solution.

According to an aspect of the present disclosure, the apparatus may include means for sampling the fuel rail pressure signal in a crankshaft angular domain (i.e. referred to the angular position of the engine crankshaft). The advantage of this aspect is that the determination of the fuel injected quantity becomes independent from the engine speed.

According to another aspect of the present disclosure, the means for calculating the value of the first function may include the following integral transform:

$$L_\alpha=\int_0^{2\pi}P(\Theta)\cdot\cos(\Theta)d(\Theta)\cong T_\alpha(\Delta P_{inj},\gamma_{inj})=\Delta P_{inj}\cdot\sin\gamma_{inj}$$

wherein:

$L_\alpha$ is the value of the first function $T_\alpha$;

P is the fuel rail pressure;

$\Theta$ is the angular position of the crankshaft;

0 is a predetermined starting value of an integration interval [0, 2n] in the crankshaft angular domain;

$2\pi$ is a predetermined final value of the integration interval [0, $2\pi$] in the crankshaft angular domain;

$\Delta P_{inj}$ is the fuel rail pressure drop caused by the fuel injection; and $\gamma_{inj}$ is an angular distance of the fuel injection from the staring value 0 of the integration interval.

As can be understood from the equations, this integral transform is effectively able to yield a value $L_\alpha$ of first function $T_\alpha$ that, with good approximation, depends only on the fuel rail pressure drop $\Delta P_{inj}$ and on the instant when the fuel injection occurs, namely the angular distance $\gamma_{inj}$.

According to another aspect of the present disclosure, the means for calculating the value of the second function including with the following integral transform:

$$L_\beta=\int_0^{2\pi}P(\Theta)\cdot\sin(\Theta)d(\Theta)\cong T_\beta(\Delta P_{inj},\gamma_{inj})=\Delta P_{inj}\cdot(1-\cos\gamma_{inj})$$

wherein:

$L_\beta$ is the value of the second function $T_\beta$;

P is the fuel rail pressure;

$\Theta$ is an angular position of the crankshaft;

0 is a predetermined starting value of an integration interval [0, $2\pi$] in the crankshaft angular domain;

$2\pi$ is a predetermined final value of the integration interval [0, $2\pi$] in the crankshaft angular domain;

$\Delta P_{inj}$ is the fuel rail pressure drop caused by the fuel injection; and $\gamma_{inj}$ is the angular distance of the fuel injection from the starting value of the integration interval.

As can be understood from the equations, this integral transform is effectively able to yield a value $L_\beta$ of a second function $T_\beta$ that, with good approximation, depends only on the fuel rail pressure drop and on the instant when the fuel injection occurs, which is still represented by the angular distance $\gamma_{inj}$.

An aspect of the present disclosure provides that the starting value of the integration interval may be an angular position of the crankshaft for which a piston of the fuel pump has already completed the compression stroke. This solution guarantees that, during the integration interval, the fuel rail pressure is not affected by the pump.

According to another aspect of the present disclosure, the apparatus may include means for calculating the fuel quantity injected by the fuel injection taking into account a value of an hydraulic capacitance of the fuel rail. This aspect of the present disclosure provides a reliable solution for calculating the fuel injected quantity starting from the pressure drop within the fuel rail.

An aspect of the present disclosure particularly provides that the apparatus may include means for varying the value of the hydraulic capacitance on the basis of an average value of the pressure within the fuel rail. This aspect of the present disclosure increases the reliability of the strategy, since the hydraulic capacitance of the fuel rail generally depends on the pressure level.

According to another aspect of the present disclosure, the apparatus may include means for performing, while the engine operates under a fuel cut-off condition (even during the execution of a stop-start running strategy), a learning procedure to determine the hydraulic capacitance. The means for performing the learning procedure including means for operating the fuel pump to deliver a predetermined volume of fuel into the fuel rail per compression stroke, means for measuring a value of a fuel rail pressure increment due to the delivery of said volume of fuel, and means calculating the value of the hydraulic capacitance as a function of the volume of fuel delivered into the fuel rail and the measured value of the fuel rail pressure increment. This solution provides a reliable and effective strategy for learning the hydraulic capacitance of the fuel rail.

An aspect of the present disclosure provides that the means for performing the learning procedure may further include means for calculating an average value of the fuel rail pressure during the delivery of said volume of fuel, and means for memorizing the calculated value of the hydraulic capacitance, thereby correlating it to the calculated average value of the fuel rail pressure. This solution creates an array or map that correlates each value of the fuel rail pressure with a corresponding value of the hydraulic capacitance, which in turn may be effectively used to calculate the fuel injected quantity.

According to an aspect of the present disclosure, the fuel injection performed by the fuel injector may include a single injection pulse. This aspect of the present disclosure, which may be implemented while the internal combustion engine is running under cut-off conditions, can be reliably used to determine the fuel quantity that is actually injected by a single injection pulse.

According to another aspect of the present disclosure, the fuel injection performed by the fuel injector may include a plurality of injection pulses, for example according to a multi-injection pattern. This aspect of the present disclosure, which may be implemented either under cut-off conditions or normal operating conditions, can be reliably used to determine the overall fuel quantity that is actually injected by the fuel injector per engine cycle.

The apparatus may further include means for calculating a difference between the calculated value of the fuel injected quantity and a predetermined target value thereof, and means for using the calculated difference to correct an energizing time of the fuel injector. This aspect of the present disclosure realizes a closed-loop control strategy for compensating possible errors of the fuel injected quantity.

Another aspect of the present disclosure provides that the apparatus may further include means for calculating a difference between the calculated value of the timing parameter and a predetermined target value thereof, and means for using the calculated difference to correct a start of injection of the fuel injector. This aspect of the present disclosure realizes a closed-loop control strategy for compensating possible errors of the injection timing.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background, summary or description of drawings or the following detailed description.

Figure 1:
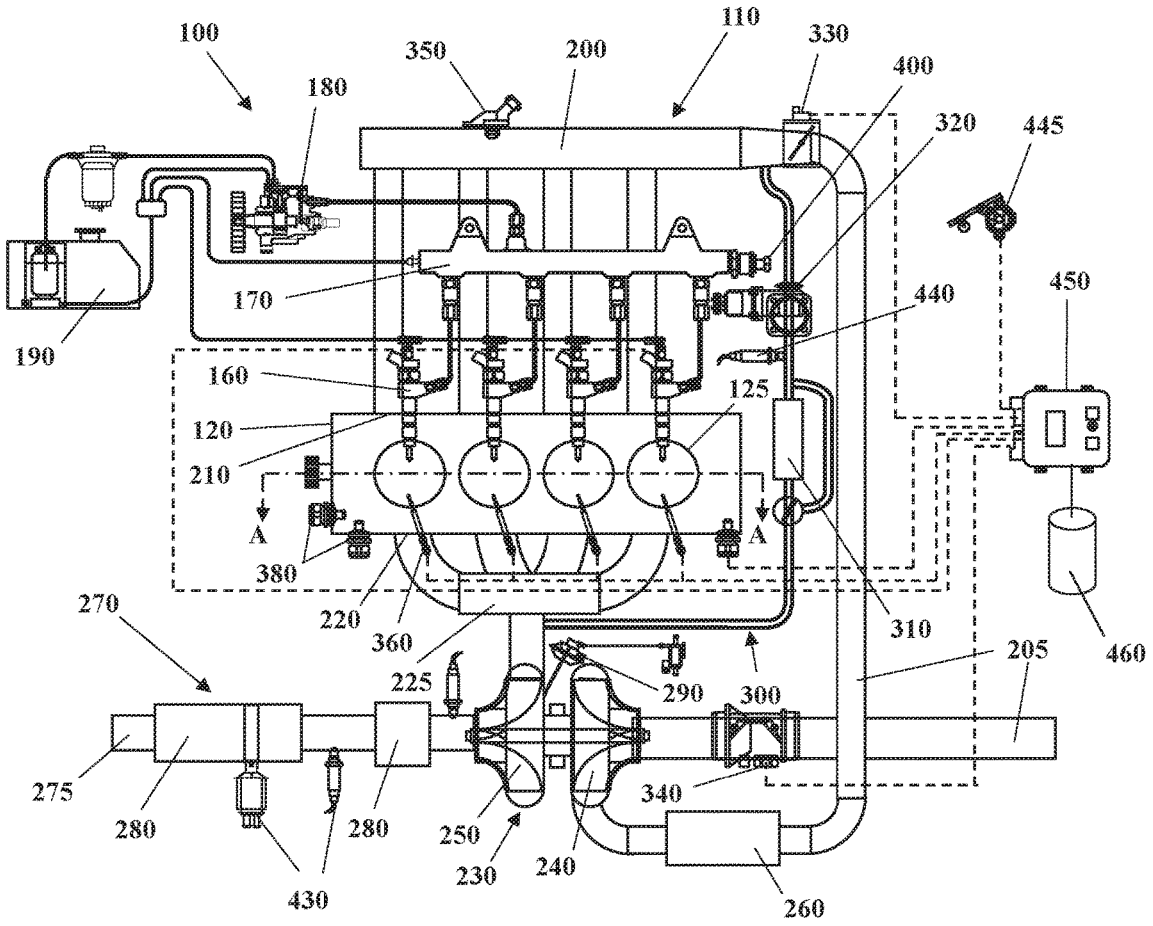
FIG. 1 schematically shows an automotive system.
Figure 2:
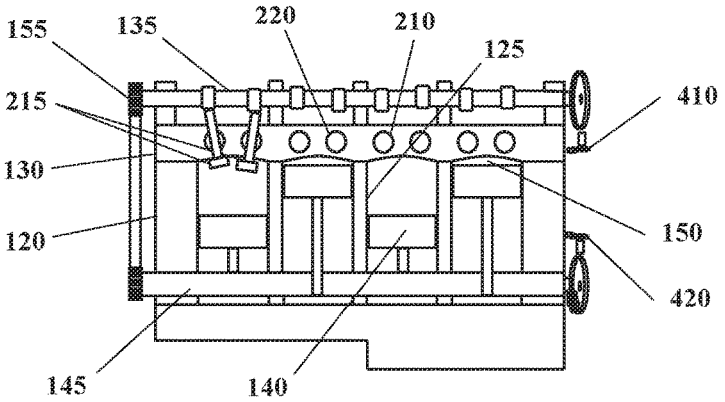
FIG. 2 is the section A-A of FIG. 1.

Some embodiments may include an automotive system 100 (e.g. a motor vehicle), as shown in FIGS. 1 and 2, that includes an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150. A fuel and air mixture (not shown) is disposed in the combustion chamber 150 and ignited, resulting in hot expanding exhaust gasses causing reciprocal movement of the piston 140. The fuel is provided by at least one fuel injector 160 per combustion chamber and the air through at least one intake port 210. The fuel is provided at high pressure to the fuel injector 160 from a fuel rail 170 in fluid communication with a high pressure fuel pump 180 that increase the pressure of the fuel received from a fuel source 190.

The high pressure fuel pump 180 may be embodied as a volumetric pump having a cylinder and a reciprocating piston which is accommodated inside the cylinder to define an operating chamber. The piston is driven by the engine crankshaft 145 through a timing system and moves between a Top Dead Center (TDC) position, which corresponds to a minimum volume of the operating chamber, and a Bottom Dead Center (BDC) position, which corresponds to a maximum volume of the operating chamber. Due to this reciprocating movement, the piston cyclically performs a suction stroke that fills the operating chamber with the fuel coming from the fuel source 190, followed by a compression stroke that delivers the fuel at high pressure inside the fuel rail 170.

Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust system 270 may include an exhaust pipe 275 having one or more exhaust aftertreatment devices 280. The aftertreatment devices may be any device configured to change the composition of the exhaust gases. Some examples of aftertreatment devices 280 include, but are not limited to, catalytic converters (two and three way), oxidation catalysts, lean $NO_x$ traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a now of exhaust gases in the EGR system 300.

The automotive system 100 may further include an electronic control unit (ECU) 450 in communication with one or more sensors and/or devices associated with the ICE 110. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an EGR temperature sensor 440, and an accelerator pedal position sensor 445. Furthermore, the ECU 450 may generate output signals to various control devices that are arranged to control the operation of the ICE 110, including, but not limited to, the fuel injectors 160, the throttle body 330, the EGR Valve 320, the VGT actuator 290, and the cam phaser 155. Note, dashed lines are used to indicate communication between the ECU 450 and the various sensors and devices, but some are omitted for clarity.

Turning now to the ECU 450, this apparatus may include a digital central processing unit (CPU) in communication with a memory system and an interface bus. The CPU is configured to execute instructions stored as a program in the memory system 460, and send and receive signals to/from the interface bus. The memory system 460 may include various non-transitory, computer-readable storage medium including optical storage, magnetic storage, solid state storage, and other non-volatile memory. The interface bus may be configured to send, receive, and modulate analog and/or digital signals to/from the various sensors and control devices. The program may embody the methods disclosed herein, allowing the CPU to carryout out the steps of such methods and control the ICE 110.

The program stored in the memory system 460 is transmitted from outside via a cable or in a wireless fashion. Outside the automotive system 100 it is normally visible as a computer program product, which is also called computer readable medium or machine readable medium in the art, and which should be understood to be a computer program code residing on a carrier, said carrier being transitory or non-transitory in nature with the consequence that the computer program product can be regarded to be transitory or non-transitory in nature.

An example of a transitory computer program product is a signal, e.g. an electromagnetic signal such as an optical signal, which is a transitory carrier for the computer program code. Carrying such computer program code can be achieved by modulating the signal by a conventional modulation technique such as QPSK for digital data, such that binary data representing said computer program code is impressed on the transitory electromagnetic signal. Such signals are e.g. made use of when transmitting computer program code in a wireless fashion via a WiFi connection to a laptop.

In case of a non-transitory computer program product the computer program code is embodied in a tangible storage medium. The storage medium is then the non-transitory carrier mentioned above, such that the computer program code is permanently or non-permanently stored in a retrievable way in or on this storage medium. The storage medium can be of conventional type known in computer technology such as a flash memory, an Asic, a CD or the like.

Instead of an ECU 450, the automotive system 100 may have a different type of processor to provide the electronic logic, e.g. an embedded controller, an onboard computer, or any processing module that might be deployed in the vehicle. One of the tasks of the ECU 450 is that of operating the fuel injectors 160 to inject fuel into the combustion chambers 150. In this regard, it should be observed that each fuel injector 160 is generally embodied as an electromechanical valve having a nozzle in fluid communication with the corresponding combustion chamber 150, a needle, which is normally biased by a spring in a closed position of the nozzle, and an electro-magnetic actuator (e.g. solenoid), which moves the needle towards an open position of the nozzle in response of an energizing electrical current. In this way, any time the electro-magnetic actuator is provided with the energizing electrical current (also named electrical command), a direct connection is opened between the fuel rail 170 and the cylinder 125, which let a certain quantity of fuel to be injected into the combustion chamber 150. Any one of these events is conventionally referred as "injection pulse".

During normal operations, the ECU 450 generally commands each fuel injector 160 to perform a "fuel injection" per engine cycle, wherein the fuel injection includes a plurality of injection pulses according to a multi-injection pattern. The timing of each single injection pulse generally depends on the instant when the electric command is applied to the actuator of the fuel injector 160. Therefore, the ECU 450 is generally configured to determine the Start Of Injection (SOI) of the injection pulse and then to start the application of the electric command accordingly. The SOI is generally expressed as the angular position of the engine crankshaft 145 when the fuel injection starts. This angular position is normally quantified as an angular displacement, namely a difference between the angular position of the crankshaft 145 at the time when the fuel injection starts and a predetermined angular position of the crankshaft 145, which is chosen as a reference. The reference angular position of the crankshaft 145 is usually chosen as the position for which the piston 140 reaches the Top Dead Center (TDC).

The fuel quantity injected into the combustion chamber 150 by each single injection pulse generally depends on the pressure of the fuel in the fuel rail 170 and on the needle displacement, which is correlated with the duration of the electrical command (i.e. energizing time ET). Therefore, the ECU 450 is generally configured to determine the fuel quantity to be injected with each single injection pulse, to calculate the energizing time necessary for injecting, the desired fuel quantity, and finally to energize the fuel injector 160 accordingly.

However, the SOI and/or the quantity of fuel actually injected by the fuel injector 160 may sometimes be different with respect to the desired ones, due to aging effect and/or production spread of the fuel injector 160. For this reason, the ECU 450 may be configured to perform a method for determining the real SOI and the real quantity of fuel injected by each of the fuel injector 160 in response to a given energizing time, for example in order to diagnose the efficiency of the injection system and/or to be able to correct the electric command with the aim of injecting exactly a desired fuel quantity and/or with the desired timing.

Figure 3:
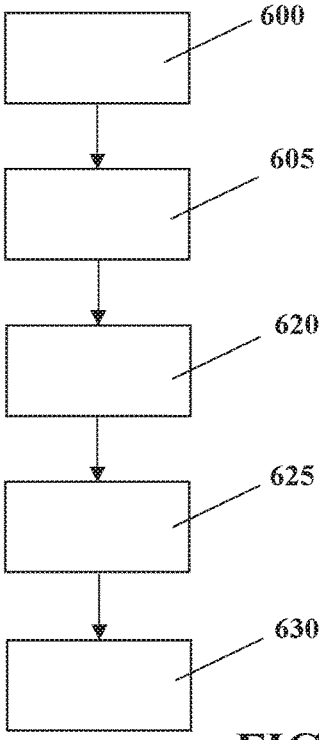
FIG. 3 is a flowchart that represents a method for determining the actual fuel quantity that is injected by an engine fuel injector and the instant when such fuel injection actually occurs.

This method may be performed while the engine is under a cut-off condition, for example but not exclusively during the execution of a stop-start running strategy, and may require that the ECU 450 operates one fuel injector 160 at the time, while keeping the other inactive As shown in the flowchart of FIG. 3, the method prescribes to energize the fuel injector 160 for a predetermined energizing time to perform a fuel injection (block 600). This fuel injection may include a single (i.e. only one) injection pulse or a plurality of injection pulses according to a predetermined multi-injection pattern. While executing the fuel injection, the strategy also prescribes to sample the pressure within the fuel rail 170 (block 605). The fuel rail pressure may be sampled by means of the fuel rail pressure sensor 400. In particular, the pressure may be sampled in an angular domain (i.e. referred to the crankshaft angular position), in order to make it independent from the engine speed.

Figure 4:
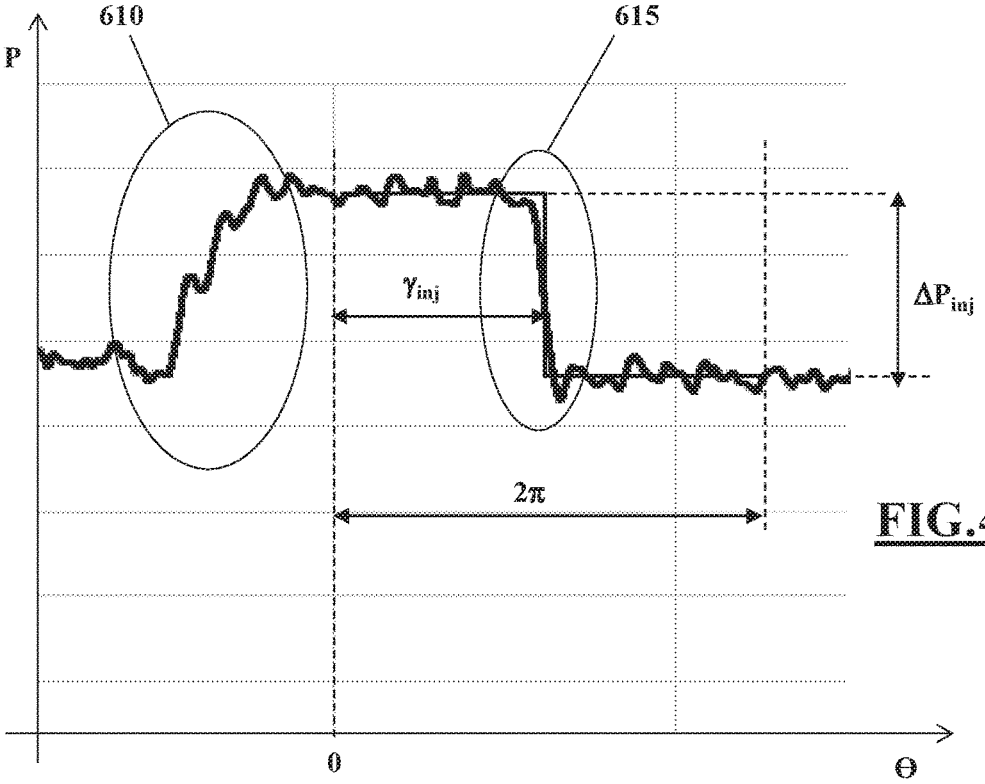
FIG. 4 is a diagram that represents the fuel rail pressure variation over the crankshaft angular position during the execution of the method of FIG. 3.

Under these prescribed conditions, variation of pressure within the fuel rail 170 is generally affected by the fuel injection and by the fuel delivered by the high pressure fuel pump 180, so that the graph of the pressure P over the crankshaft angular position Θ should be of the kind shown in FIG. 4. As a matter of fact, the fuel rail pressure P has an increment, indicated by the ellipses 610, which is caused by the compression stroke of the high pressure fuel pump 180, and a drop, indicated by the ellipses 615, which is caused by the fuel injection.

As can be seen from FIG. 4, it is possible to determine an angular interval that contains the pressure drop caused by the fuel injection but not the increment caused by the pump. To this angular interval can be assigned an extension ranging from 0 to 2π, even if this angular interval does not actually correspond to a full rotation of the crankshaft 145, but actually to a selected portion of it. In this way, during the selected angular interval [0, 2π] the fuel rail pressure is affected by the fuel injection and not by the pump 180. To achieve this effect, at least the staring value 0 of the angular interval [0, 2π] should be chosen as an angular position of the crankshaft 145 that corresponds to a position of the piston of the fuel pump 180 included between its Top Dead Center (TDC) position and its Bottom Dead Center (BDC) position. More particularly, when the crankshaft 145 is in the starting angular position 0, the piston of the fuel pump 180 should be performing the suction stroke, after having passed the IDC position and thus competed the compression stroke.

Using the angular interval [0, 2π] as interval of integration, the strategy may prescribe that the ECU 450 calculates the following integral transforms (block 620):

$$L_\alpha=\int_0^{2\pi}P(\theta)\cdot\cos(\theta)d(\theta)$$

$$L_\beta=\int_0^{2\pi}P(\theta)\cdot\sin(\theta)d(\theta)$$

wherein:

$L_\alpha$ is the value yielded by the first integral transform;

$L_\beta$ is the value yielded by the second integral transform;

P is the fuel rail pressure;

Θ is the angular position of the crankshaft;

θ is the predetermined starting value of the integration interval [0, 2π] in the crankshaft angular domain; and 2π is the predetermined final value of the integration interval [0, 2π] in the crankshaft angular domain.

Looking at FIG. 4, the pressure P of the fuel rail may be considered as the sum of two contributions:

$$P=P_{eq}+\delta P_{noise}$$

wherein:

$P_{eq}$ represents an equivalent pressure (e.g. a mean pressure) of the fuel rail 170; and $\delta P_{noise}$ represents the pressure fluctuations due to the pressure waves and electronic noise of the sensor.

As a consequence, the preceding integral transforms may be rewritten as follows:

$$L_\alpha=\int_0^{2\pi}P(\theta)\cdot\cos(\theta)d(\theta)=\int_0^{2\pi}[P_{eq}+\delta P_{noise}]\cdot\cos(\theta)d(\theta)$$

$$L_\beta=\int_0^{2\pi}P(\theta)\cdot\sin(\theta)d(\theta)=\int_0^{2\pi}[P_{eq}+\delta P_{noise}]\cdot\sin(\theta)d(\theta)$$

However, the frequency spectrum of the pressure fluctuations $\delta P_{noise}$ is much higher than the frequency spectrum of the equivalent pressure $P_{eg}$, so that the contribution of the pressure fluctuations to the integral transform is negligible:

$$\int_0^{2\pi}\delta P_{noise}\cdot\cos(\theta)d(\theta)\approx\int_0^{2\pi}\delta P_{noise}\cdot\sin(\theta)d(\theta)\approx 0$$

As a consequence, the preceding integral transforms may be rewritten as follows:

$$L_\alpha=\int_0^{2\pi}P(\theta)\cdot\cos(\theta)d(\theta)\approx\int_0^{2\pi}P_{eq}\cdot\cos(\theta)d(\theta)=T_\alpha(\Delta P_{inj},\gamma_{inj})=\Delta P_{inj}\cdot\sin\gamma_{inj}$$

$$L_\beta=\int_0^{2\pi}P(\theta)\cdot\sin(\theta)d(\theta)\approx\int_0^{2\pi}P_{eq}\cdot\sin(\theta)d(\theta)=T_\beta(\Delta P_{inj},\gamma_{inj})=\Delta P_{inj}\cdot(1-\cos\gamma_{inj})$$

wherein:

$\Delta P_{inj}$ is the fuel rail pressure drop caused by the fuel injection;

$\gamma_{inj}$ is the angular distance of the fuel injection from the staring value 0 of the integration interval [0, 2π]; and, $T_\alpha$ and $T_\beta$ are two functions having as variables the fuel rail pressure drop $\Delta P_{inj}$ and the angular distance $\gamma_{inj}$.

After having calculated the values $L_\alpha$ and $L_\beta$, the ECU 450 may thus calculate (block 625) the fuel rail pressure drop $\Delta P_{inj}$ and the angular distance $\gamma_{inj}$ with the following equations:

$$\Delta P_{inj} = -\frac{L_\alpha^2 + L_\beta^2}{2L_\beta}$$

$$\gamma_{inj} = \arcsin\left(-\frac{2L_\alpha L_\beta}{L_\alpha^2 + L_\beta^2}\right)$$

In this way, the angular distance $\gamma_{inj}$ provides a measurement of the Start of Injection (SOI), whereas the fuel rail pressure drop $\Delta P_{inj}$ can be used to calculate the fuel quantity actually injected by the fuel injection (block 630).

Figure 5:
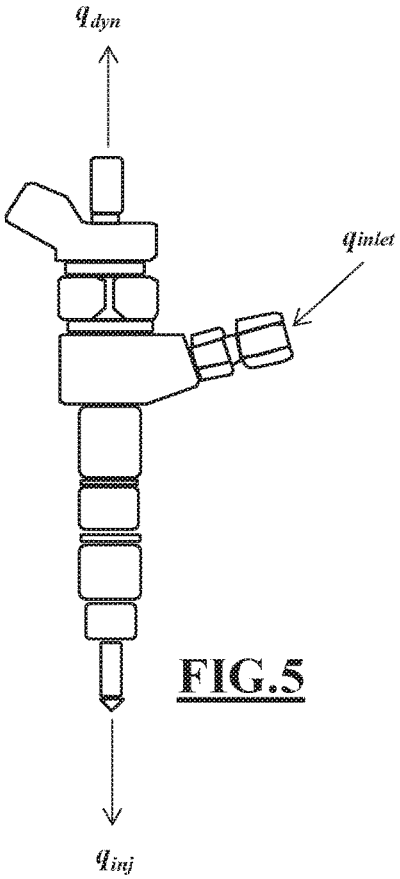
FIG. 5 shows in greater details a fuel injector of the automotive system of FIG. 1.

More particularly, the fuel rail pressure drop $\Delta P_{inj}$ can be used to calculate a dynamic fuel quantity $q_{inlet}$ that actually flows through the fuel injector 160 according to the following equation:

$$=q_{inlet}=C_{hyd}\cdot\Delta P_{inj}$$

wherein $C_{hyd}$ is the value of the hydraulic capacitance of the fuel rail 170, As represented in FIG. 5, the dynamic fuel quantity $q_{inlet}$ is the sum of two contributions, namely the fuel injected quantity $g_{inj}$ and the dynamic leakage $q_{dyn}$. The fuel injected quantity $g_{inj}$ is the quantity of fuel that actually enters the combustion chamber 150, whereas dynamic leakage $q_{dyn}$ is a quantity of fuel that, when the injector needle is moved in the open position, flows through a backflow outlet of the fuel injector 160 and returns into the fuel source 190. As a consequence, the dynamic fuel quantity $q_{inlet}$ that globally flows through the fuel injector 160 during a fuel injection (in addition to the static leakage that is always present) may be considered as the sum of the fuel injected quantity $g_{inj}$ and the dynamic leakage $q_{dyn}$:

$$q_{inlet}=q_{inj}+q_{dyn}$$

However, $q_{inlet}$, $g_{inj}$ and $q_{dyn}$ are parameters that depend only on the fuel pressure at the inlet of the fuel injector 160 and on the energizing time (which determines the needle lift), Therefore, knowing $q_{inlet}$, the fuel pressure and the energizing time used to perform the fuel injection, it is possible to determine the value $q_{inj}$ of the fuel injected quantity as a function of $q_{inlet}$:

$$q_{inj}=f(q_{inlet})$$

Figure 6:
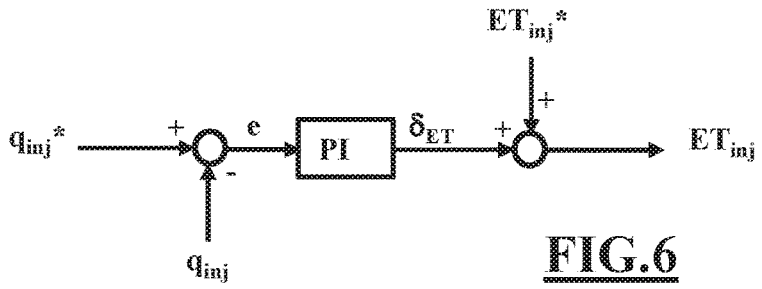
FIG. 6 is a flowchart that represents a close-loop control strategy of the fuel injected quantity.

The method disclosed above may be involved in a closed-loop control strategy of the fuel injected quantity. As shown in FIG. 6, this strategy may provide for determining the value $q_{inj}$ of the fuel injected quantity according to the method above, calculating a difference e between the calculated value $q_{inj}$* and a predetermined target value of the fuel injected quantity, and then to use said difference to correct an energizing time $ET_{inj}$* to be applied to the fuel injector 160, in order to minimize the error. In particular, the calculated difference e may be used as input of a controller, for example a proportional-integrative (PI) controller, that yields as output a correction value $\delta_{ET}$ to be added to the energizing time $ET_{inj}$*, in order to obtain a corrected energizing time $ET_{inj}$ that is finally used to operate the fuel injector 160.

Figure 7:
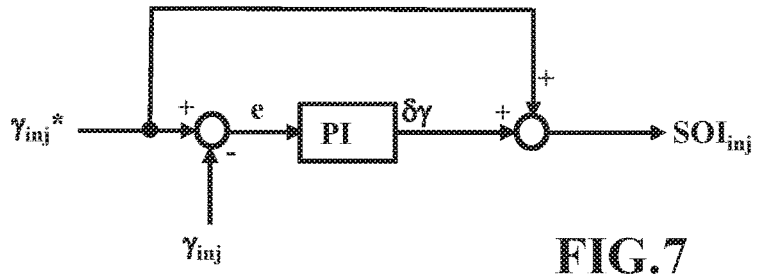
FIG. 7 is a flowchart that represents a closed-loop control strategy of the start of injection.

At the same time or as an alternative, the method disclosed above may be involved in a closed-loop control strategy of the SOI. As shown in FIG. 7, this strategy may provide for determining the value $\gamma_{inj}$ of the SOI according to the method above, calculating a difference e between the calculated value $\gamma_{inj}$ and a predetermined target value $\gamma_{inj}$* of the SOI, and then to use said difference to correct the target value $\gamma_{inj}$* before using it to operate to the fuel injector 160, in order to minimize the error. In particular, the calculated difference e may be used as input of a controller, for example a proportional-integrative (PI) controller, that yields as output a correction value $\delta_\gamma$ to be added to the target value $\gamma_{inj}$*, in order to obtain a corrected value $SOI_{inj}$ of the start of injection that is finally used to operate the fuel injector 160.

Turning now to the hydraulic capacitance of the fuel rail 170, this parameter depends on constructional and geometrical characteristics of the fuel rail 170. For this reason, the value $C_{hyd}$ of hydrodynamic capacitance may be a calibration parameter, which can be determined by means of an experimental activity and then stored in the memory system 460.

However, the hydraulic capacitance depends also on the fuel properties and on the fuel pressure within the fuel rail 170, so that the value $C_{hyd}$ determined by means of the experimental activity may not always be reliable. For this reason, a dedicated learning procedure may be executed from time to time, in order to determine the actual value of the hydraulic capacitance.

This learning procedure may be performed while the engine 110 operates under a fuel cut-off condition (even during the execution of a stop-start running strategy). When the engine 110 operates under a fuel cut-off condition, the pressure within the fuel rail 170 is conventionally decreased to a minimum allowable value thereof, which is indicated with $P_0$ in FIG. 8. Under these conditions, the learning phase may prescribe to operate the fuel pump 180 to deliver a predetermined volume Q of fuel into the fuel rail 170 per compression stroke. By way of example, the fuel pump 180 may be arranged to deliver its maximum fuel quantity, so that the fuel volume Q may be calculated with the following equation:

$$Q=v\cdot\mu$$

wherein V is the pump displacement and μ is the pump volumetric efficiency.

Figure 8:
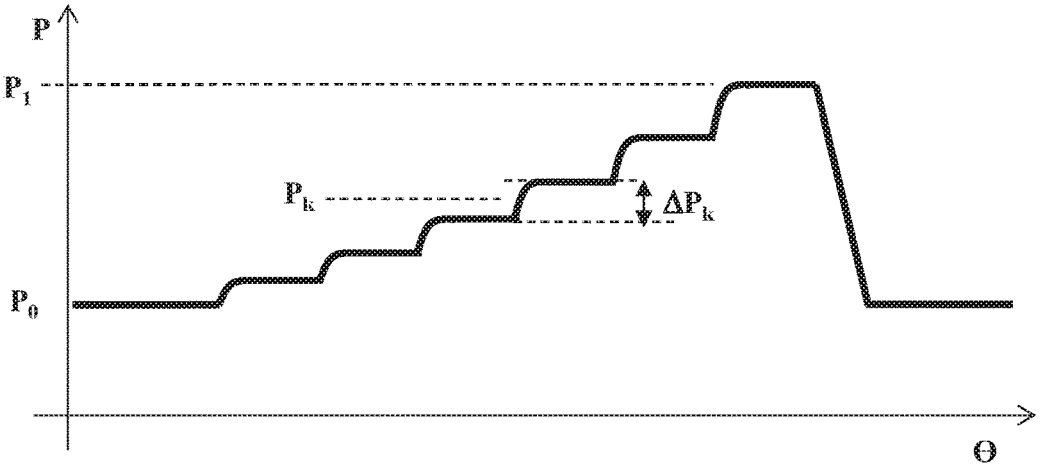
FIG. 8 is a diagram that represents the fuel rail pressure variation over the crankshaft angular position during the execution of a learning procedure of the hydraulic capacitance of the fuel rail.

While the fuel pump is operated in this way, the strategy may provide for monitoring the fuel rail pressure, which is expected to increase step by step from the minim value $P_0$ to a predetermined maximum value $P_1$ as shown in FIG. 8.

For each step, the learning procedure may prescribe to calculate a value $\Delta P_k$ of a fuel rail pressure increment due to the delivery of the volume Q of fuel and an average value $P_k$ of the fuel rail pressure, namely an average between the pressure values before and after the delivery of said volume Q of fuel.

The calculated value $\Delta P_k$ may then be used to calculate the value $C_{hyd,k}$ of the hydraulic capacitance according to the following equation:

$$C_{hyd,k} = \frac{Q}{\Delta P_k}$$

The value $C_{hyd,k}$ of the hydraulic capacitance may be finally memorized in the memory system 460, thereby correlating it to the corresponding average value $P_k$ of the fuel rail pressure. In this way, it is possible to generate an array or map that correlates each value of the fuel rail pressure $P_k$ with a corresponding value of the hydraulic capacitance $C_{hyd,k}$, which in turn may be effectively used to calculate the fuel injected quantity according to the method set forth above.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A method of operating an internal combustion engine having a fuel rail in fluid communication with a fuel pump and a fuel injector, the method comprising:

operating the fuel injector to perform a fuel injection;

sampling a pressure signal representative of a fuel pressure within the fuel rail during the fuel injection;

using the pressure signal as a first input of a first integral transform yielding a first function value based on a fuel rail pressure drop caused by the fuel injection and a timing parameter indicative of an instant when the fuel injection started;

using the pressure signal as a second input of a second integral transform yielding a second function value based on the fuel rail pressure drop caused by the fuel injection and the timing parameter indicative of the instant when the fuel injection started;

using the first function value and the second function value to calculate a value of the fuel rail pressure drop caused by the fuel injection and a value of the timing parameter; and calculating a value of a fuel quantity injected by the fuel injection as a function of the calculated value of the fuel rail pressure drop.

2. The method according to claim 1, wherein the fuel rail pressure signal is sampled in a crankshaft angular domain.

3. The method according to claim 1, wherein the value of the first function is calculated with the following integral transform:

$$L_\alpha=\int_0^{2\pi}P(\theta)\cdot\cos(\theta)d(\theta)\cong T_\alpha(\Delta P_{inj},\gamma_{inj})=\Delta P_{inj}\cdot\sin\gamma_{inj}$$

wherein $L_\alpha$ is the value of the first function $T_\alpha$, P is the fuel rail pressure, Θ is an angular position of a crankshaft, 0 is a predetermined starting value of an integration interval [0, 2π] in the crankshaft angular domain, 2π is a predetermined final value of the integration interval [0, 2π] in the crankshaft angular domain, $\Delta P_{inj}$ is the fuel rail pressure drop caused by the fuel injection, $\gamma_{inj}$ is an angular distance of the fuel injection from the staring value 0 of the integration interval.

4. The method according to claim 1, wherein the value of the second function is calculated with the following integral transform:

$$L_\beta=\int_0^{2\pi}P(\theta)\cdot\sin(\theta)d(\theta)\cong T_\beta(\Delta P_{inj},\gamma_{inj})=\Delta P_{inj}\cdot(1-\cos\gamma_{inj})$$

wherein $L_\beta$ is the value of the second function $T_\beta$, P is the fuel rail pressure, Θ is an angular position of a crankshaft, 0 is a predetermined starting value of an integration interval [0, 2π] in the crankshaft angular domain, 2π is a predetermined final value of the integration interval [0, 2π] in the crankshaft angular domain, $\Delta P_{inj}$ is the fuel rail pressure drop caused by the fuel injection, $\gamma_{inj}$ is the angular distance of the fuel injection from the starting value of the integration interval.

5. The method according to claim 3, wherein the starting value of the integration interval is an angular position of the engine crankshaft for which a piston of the fuel pump has already completed the compression stroke.

6. The method according to claim 1, wherein the fuel injection performed by the fuel injector includes a single injection pulse.

7. The method according to claim 1, wherein the fuel injection performed by the fuel injector includes a plurality of injection pulses.

8. The method according to claim 1 further comprising:

calculating a difference between the calculated value of the fuel injected quantity and a predetermined target value thereof; and using the calculated difference to correct an energizing time of the fuel injector.

9. The method according to claim 1 further comprising:

calculating a difference between the calculated value of the timing parameter and a predetermined target value thereof; and using the calculated difference to correct a start of injection of the fuel injector.

10. A non-transitory computer readable medium having computer program comprising a computer code that when executed on a processor performs the method according to claim 1.

11. A method of operating an internal combustion engine having a fuel rail in fluid communication with a fuel pump and a fuel injector, the method comprising:

operating the fuel injector to perform a fuel injection;

sampling a pressure signal representative of a fuel pressure within the fuel rail during the fuel injection;

using the pressure signal as a first input of a first integral transform yielding a first function value based on a fuel rail pressure drop caused by the fuel injection and a timing parameter indicative of an instant when the fuel injection started;

using the pressure signal as a second input of a second integral transform yielding a second function value based on the fuel rail pressure drop caused by the fuel injection and the timing parameter indicative of the instant when the fuel injection started;

using the first function value and the second function value to calculate a value of the fuel rail pressure drop caused by the fuel injection and a value of the timing parameter; and calculating a value of a fuel quantity injected by the fuel injection as a function of the calculated value of the fuel rail pressure drop, wherein the value of the fuel quantity injected by the fuel injection is calculated taking into account a hydraulic capacitance of the fuel rail.

12. The method according to claim 11, wherein the value of the hydraulic capacitance is varied on the basis of an average value of the pressure within the fuel rail.

13. The method according to claim 11, wherein the value of the hydraulic capacitance is determined with a learning procedure, which is performed while the engine is in a fuel cut-off condition and further comprising:

operating the fuel pump to deliver a predetermined volume of fuel into the fuel rail per compression stroke;

measuring a value of a fuel rail pressure increment due to the delivery of said volume of fuel; and calculating the value of the hydraulic capacitance as a function of the volume of fuel delivered into the fuel rail and the measured value of the fuel rail pressure increment.

14. The method according to claim 13, wherein the learning procedure further comprises:

calculating an average value of the fuel rail pressure during the delivery of said volume of fuel; and memorizing the calculated value of the hydraulic capacitance, thereby correlating it to the calculated average value of the fuel rail pressure.

15. An internal combustion engine comprising a fuel pump in fluid communication with a fuel injector through a fuel rail, and an electronic control unit configured to:

operate the fuel injector to perform a fuel injection;

sample a pressure signal representative of a fuel pressure within the fuel rail during the fuel injection;

use the pressure signal as a first input of a first integral transform yielding a value of a first function value based on a fuel rail pressure drop caused by the fuel injection and a timing parameter indicative of an instant when the fuel injection started;

use the pressure signal as second input of a second integral transform yielding a second function value based on the fuel rail pressure drop caused by the fuel injection and the timing parameter indicative of the instant when the fuel injection started;

use the first function value and the second function value to calculate a value of the fuel rail pressure drop caused by the fuel injection and a value of the timing parameter; and calculate a value of a fuel quantity injected by the fuel injection as a function of the calculated value of the fuel rail pressure drop, wherein the value of the fuel quantity injected by the fuel injection is calculated taking into account a hydraulic capacitance of the fuel rail.

* * * * *